US010791898B2

(12) United States Patent
Hyun et al.

(10) Patent No.: US 10,791,898 B2
(45) Date of Patent: Oct. 6, 2020

(54) DUST COLLECTOR FOR VACUUM CLEANER

(71) Applicant: LG ELECTRONICS INC., Seoul (KR)

(72) Inventors: Kietak Hyun, Seoul (KR); Seungyeop Lee, Seoul (KR); Hyukjin Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 399 days.

(21) Appl. No.: 15/542,463

(22) PCT Filed: Jan. 13, 2016

(86) PCT No.: PCT/KR2016/000343
§ 371 (c)(1),
(2) Date: Jul. 10, 2017

(87) PCT Pub. No.: WO2016/114580
PCT Pub. Date: Jul. 21, 2016

(65) Prior Publication Data

US 2018/0271343 A1 Sep. 27, 2018

(30) Foreign Application Priority Data

Jan. 14, 2015 (KR) ..... 10-2015-0006947

(51) Int. Cl.
*A47L 9/16* (2006.01)

(52) U.S. Cl.
CPC ..... *A47L 9/1683* (2013.01); *A47L 9/1608* (2013.01); *A47L 9/1633* (2013.01); *A47L 9/1658* (2013.01); *A47L 9/1666* (2013.01)

(58) Field of Classification Search
CPC .... A47L 9/1608; A47L 9/1633; A47L 9/1683; A47L 9/165; A47L 9/1666; A47L 9/1658; A47L 9/1641
(Continued)

(56) References Cited

U.S. PATENT DOCUMENTS 4,593,429 A * 6/1986 Dyson ..... A47L 9/1633 15/335
6,578,230 B2 6/2003 Park et al.
(Continued)

FOREIGN PATENT DOCUMENTS

CH 386 215 12/1964
EP 0 885 585 12/1998
(Continued)

OTHER PUBLICATIONS

Japanese Notice of Allowance dated Dec. 13, 2018 issued in Application No. 2017-555192.
(Continued)

*Primary Examiner* — Brian D Keller
(74) *Attorney, Agent, or Firm* — Ked & Associates, LLP

(57) ABSTRACT

The present disclosure discloses a dust collector for a vacuum cleaner, including a first cyclone disposed within an outer case to filter out dust from air introduced from an outside thereof and introduce the air from which dust has been filtered out to an inside thereof, a second cyclone accommodated in the inside of the first cyclone to separate fine dust from the air introduced to the inside of the first cyclone, a first guide vane spirally extended from an annular shaped first space between the first and the second cyclone to induce rotational flow so as to introduce air introduced into the first space to an inlet of the second cyclone, and a second guide vane spirally extended along an inner circumference of the inlet to enhance the rotational flow of air
(Continued)

introduced to an inside of the second cyclone through the inlet.

19 Claims, 6 Drawing Sheets

(58) Field of Classification Search
USPC .... 55/459.1, DIG. 3, 345, 429, 337; 15/353, 15/362, 347
See application file for complete search history.

(56) References Cited

U.S. PATENT DOCUMENTS

| | | | | |
|---|---|---|---|---|
| 7,065,826 | B1 * | 6/2006 | Arnold | A47L 9/1608 15/353 |
| 7,419,522 | B2 * | 9/2008 | Arnold | A47L 9/1633 55/345 |
| 7,691,161 | B2 | 4/2010 | Oh et al. | |
| 10,052,579 | B2 * | 8/2018 | Hallgren | B04C 5/081 |
| 2001/0052166 | A1 | 12/2001 | Park et al. | |
| 2002/0020154 | A1 * | 2/2002 | Yang | A47L 9/165 55/337 |
| 2008/0155947 | A1 | 7/2008 | Oh et al. | |
| 2008/0223010 | A1 | 9/2008 | Han et al. | |
| 2010/0263161 | A1 | 10/2010 | Lee et al. | |
| 2014/0020205 | A1 * | 1/2014 | Makarov | A47L 9/1633 15/353 |

FOREIGN PATENT DOCUMENTS

| | | |
|---|---|---|
| JP | 2002-522213 | 7/2002 |
| JP | 2008-173575 | 7/2008 |
| JP | 2011-212172 | 10/2011 |
| JP | 3172934 U | 12/2011 |
| JP | 2014-036683 | 2/2014 |
| JP | 2014-042696 | 3/2014 |
| JP | 2014-076141 | 5/2014 |
| KR | 10-2007-0000634 | 1/2007 |
| KR | 10-1208492 | 12/2012 |
| WO | WO 2009/104959 | 8/2009 |

OTHER PUBLICATIONS

Japanese Office Action dated Jul. 6, 2018 issued in Application No. 2017-555192.
International Search Report (Full English Text) and Written Opinion dated Apr. 21, 2016 issued in Application No. PCT/KR2016/000343.
Russian Decision to Grant a Patent dated Jun. 18, 2018 issued in Application No. 2017128577 (with English translation).
European Search Report dated Jul. 26, 2018 issued in Application No. 16737544.3.
Korean Notice of Allowance dated Aug. 14, 2020 issued in KR Application No. 10-2015-0006947.

* cited by examiner

[Fig. 1]
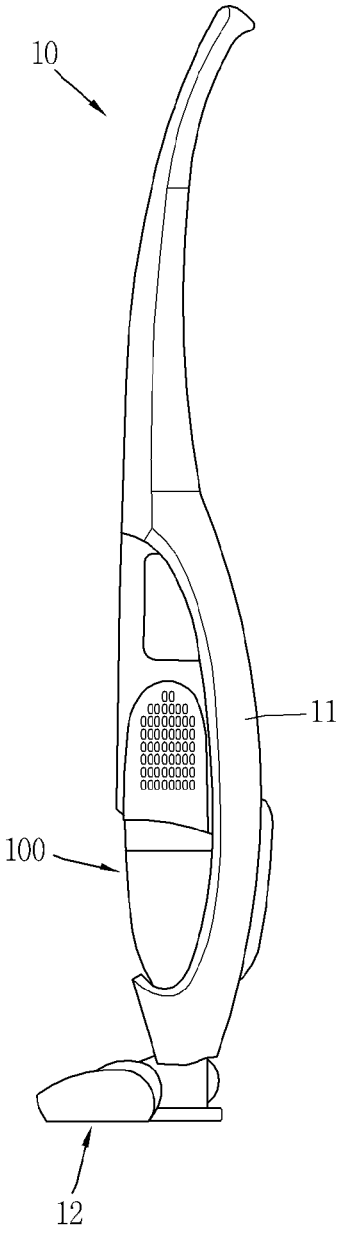

[Fig. 2]
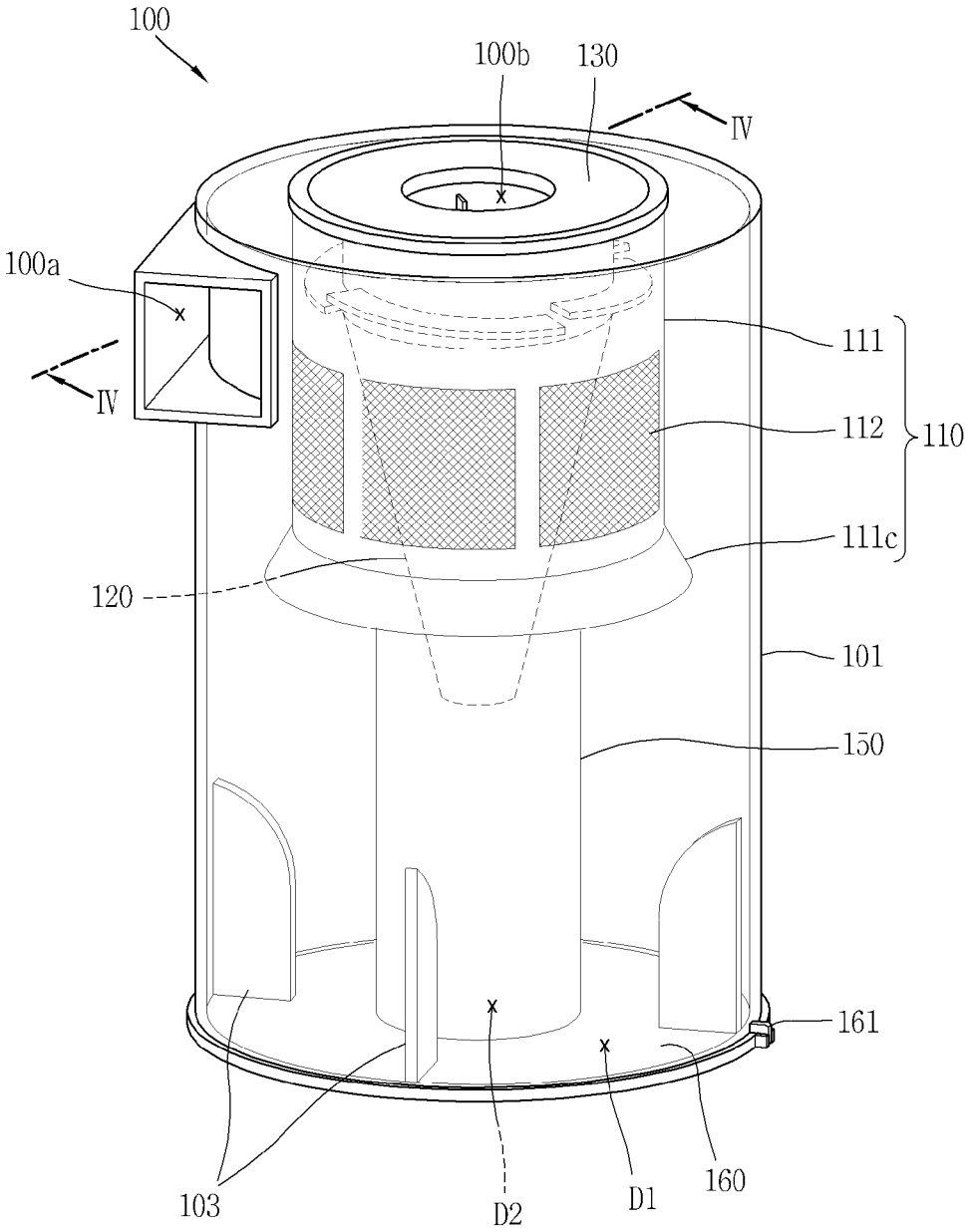

[Fig. 3]
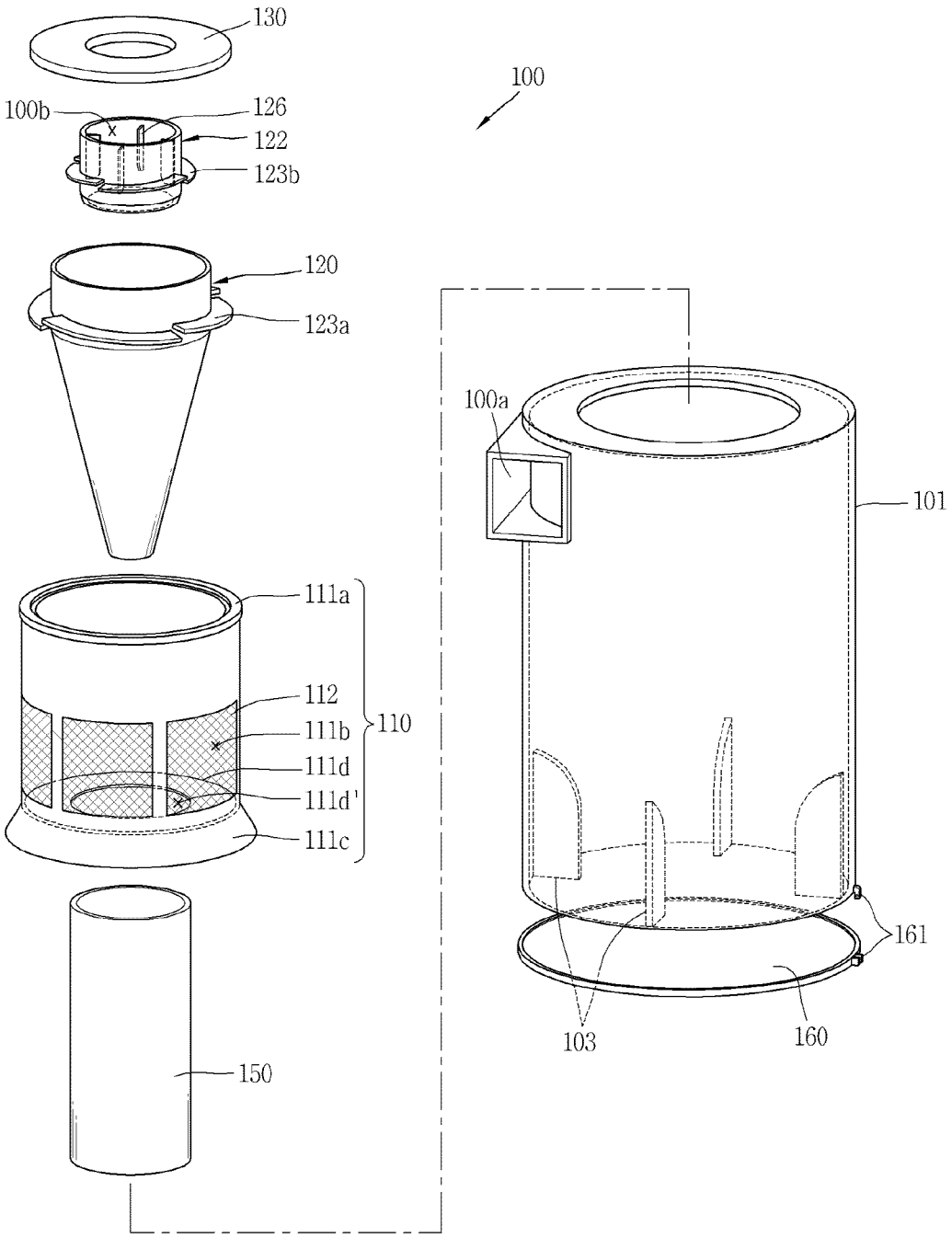

[Fig. 4]
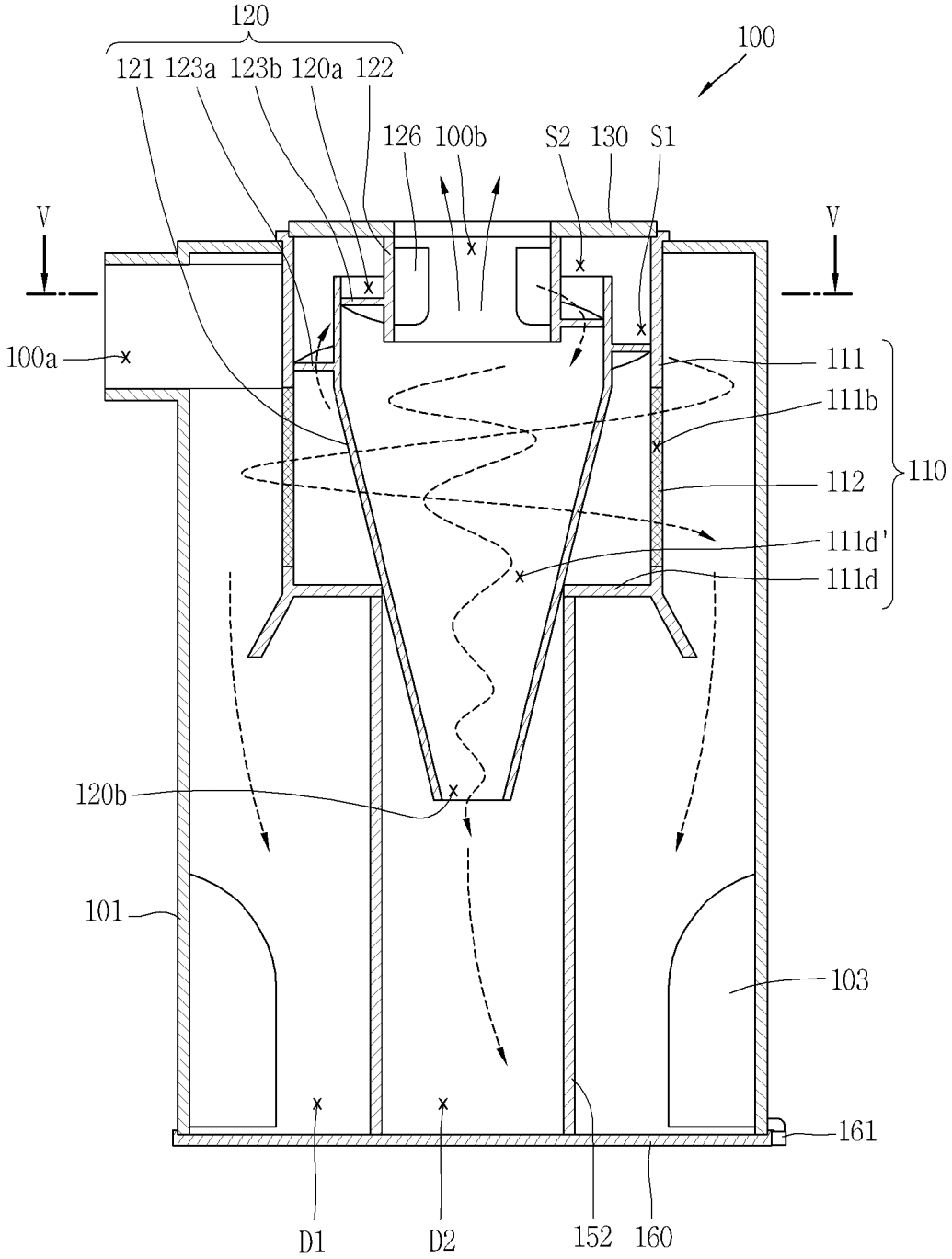

[Fig. 5]
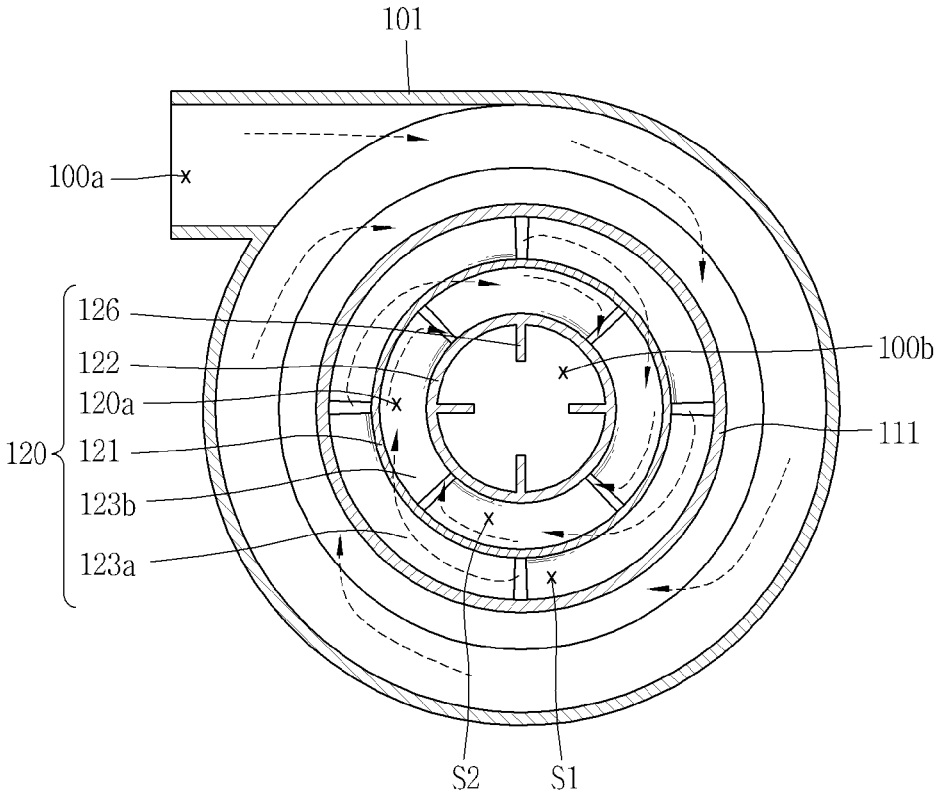

[Fig. 6]
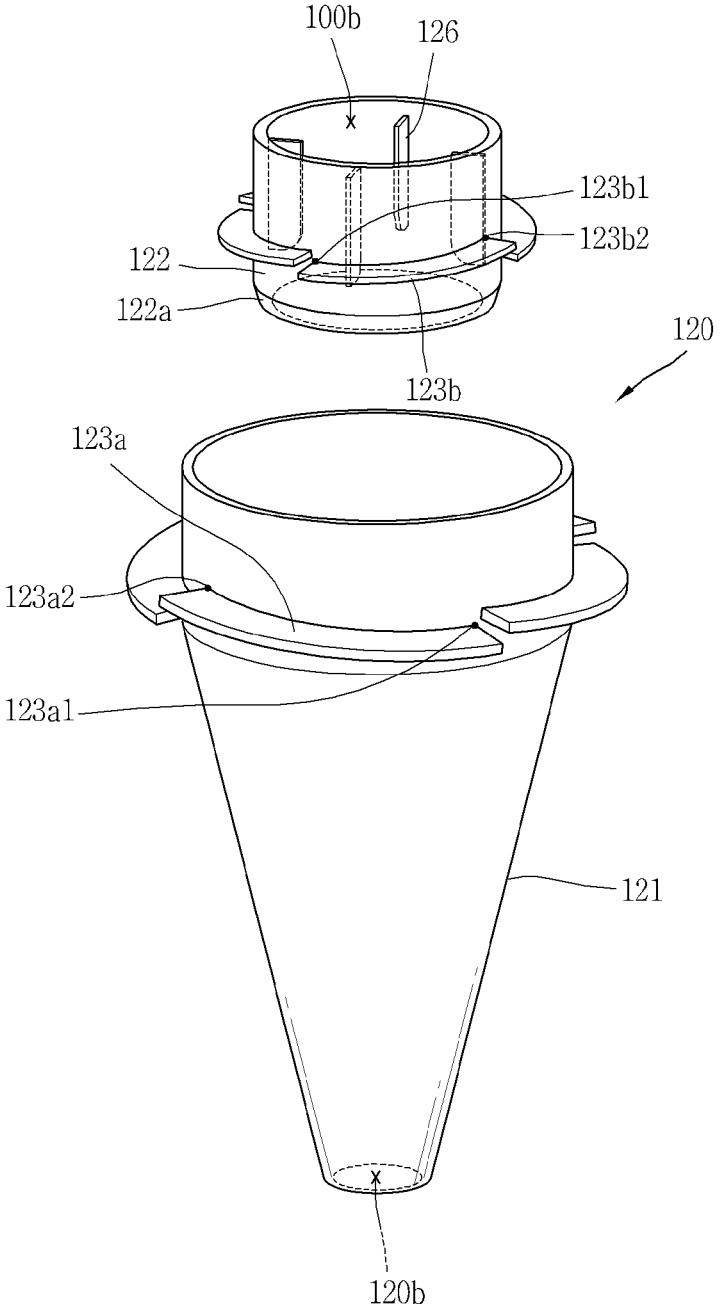

DUST COLLECTOR FOR VACUUM CLEANER

CROSS-REFERENCE TO RELATED PATENT APPLICATIONS

This application is a U.S. National Stage Application under 35 U.S.C. § 371 of PCT Application No. PCT/KR2016/000343, filed Jan. 13, 2016, which claims priority to Korean Patent Application No. 10-2015-0006947, filed Jan. 14, 2015, whose entire disclosures are hereby incorporated by reference.

TECHNICAL FIELD

The present disclosure relates to a dust collector for a vacuum cleaner configured to collect dust and fine dust in a separate manner through a multi-cyclone.

BACKGROUND ART

A vacuum cleaner is an apparatus configured to introduce air using suction power formed by a suction motor and separate dust or dirt from the air to discharge clean air.

The types of vacuum cleaners may be divided into i) a canister type, ii) an upright type, iii) a hand type, iv) a cylindrical floor type, and the like.

In recent years, the canister type vacuum cleaner is a vacuum cleaner mostly used at home, which is a vacuum cleaner with a method of communicating a suction nozzle with a body through a connecting member. The canister type may include a cleaner body, a hose, a pipe, a brush, and the like, and be suitable to clean a solid floor due to performing cleaning only with suction power.

On the contrary, the upright type vacuum cleaner is a vacuum cleaner in which a suction nozzle and a body are integrally shaped. The upright type vacuum cleaner may include a rotary brush, and thus clean up even dust or the like within a carpet, contrary to the canister type vacuum cleaner.

However, vacuum cleaners in the related art have drawbacks as follows.

First, for vacuum cleaners having a multi-cyclone structure, each cyclone is vertically disposed to cause a problem of increasing the height of a dust collector thereof. Furthermore, the dust collector is designed to have a slim profile to solve such a volume increase issue, thereby causing a disadvantage of reducing the volume of a space for collecting actual dust.

In order to solve the foregoing problem, a structure in which a second cyclone is disposed within a first cyclone has been proposed, but it is difficult to efficiently dispose the second cyclone within the first cyclone due to interference between the guide passages of the second cyclone. Even when the second cyclone is disposed within the first cyclone, the number of second cyclones is significantly decreased to reduce suction power, thereby resulting in the deterioration of cleaning performance.

In case of a typical multi-cyclone in the related art, as air introduced into the collector passes through the first cyclone, the flow speed of air decreases, thereby causing a problem in which air that has passed through the first cyclone is unable to be efficiently introduced into the second cyclone.

Even though air that has passed through the first cyclone is introduced into the second cyclone, air introduced into the second cyclone does not have a strong rotational force, thereby causing a problem in the performance of separating fine dust from the introduced air.

In particular, a tangential inhalation type cyclone structure in the related art should have provided with a guide passage for tangentially introducing air and fine dust to an inside thereof. The foregoing tangential inhalation type cyclone structure has low passage usability, and the size of the cyclone decreases due to the installation of the guide passage, thereby causing a problem of increasing the entire passage loss.

On the other hand, for cleaners in the related art, there exists a limit in providing the user's convenience even during the dust discharge process. There are vacuum cleaners in which dust is blown away during the process of discharging the dust, and also exist vacuum cleaners requiring a very complicated process to discharge dust.

DISCLOSURE OF INVENTION

Technical Problem

An aspect of the present disclosure is to provide a dust collector for a vacuum cleaner with a new structure in which a multi-cyclone structure is improved to lower down the height without reducing the cleaning performance.

Furthermore, another aspect of the present disclosure is to propose a dust collector for efficiently introducing air that has passed through the first cyclone to the second cyclone as well as further enhancing the rotational flow of air introduced into the second cyclone On the other hand, yet still another aspect of the present disclosure is to propose a dust collector capable of collecting dust and fine dust in a separate manner as well as easily discharging them at the same time.

Solution to Problem

In order to solve the foregoing tasks of the present disclosure, a dust collector for a vacuum cleaner according to an embodiment of the present disclosure may include a first cyclone disposed within an outer case to filter out dust from air introduced from an outside thereof and introduce the air from which dust has been filtered out to an inside thereof, a second cyclone accommodated in the inside of the first cyclone to separate fine dust from the air introduced to the inside of the first cyclone, a first guide vane spirally extended from an annular shaped first space between the first and the second cyclone to induce rotational flow so as to introduce air introduced into the first space to an inlet of the second cyclone, and a second guide vane spirally extended along an inner circumference of the inlet to enhance the rotational flow of air introduced to an inside of the second cyclone through the inlet.

According to an example associated with the present disclosure, a plurality of the first guide vanes may be provided, and disposed to be spaced from each other at predetermined intervals along an inner circumference of the first cyclone or an outer circumference of the second cyclone.

An entrance extended toward an inner circumference of the outer case may be formed at an upper portion of the outer case to rotate air introduced from an outside in one direction, and the first guide vane may be formed in an inclined manner upward along the one direction to rotate and move air introduced into the first space upward in the one direction.

The first guide vane may be formed to be protruded from an outer circumference of the second cyclone toward an inner circumference of the first cyclone.

The second guide vane may be formed in an inclined manner downward along the one direction to allow the air rotated and moved upward in the one direction along the first guide vane to be rotated and moved downward in the one direction and introduced to an inside of the second cyclone.

According to another example associated with the present disclosure, a vortex finder may be provided at the center of the second cyclone to discharge air from which fine dust is separated, and the second guide vane may be installed on the inlet, which is a space between the vortex finder and an inner circumference of the second cyclone.

A plurality of second guide vanes may be provided, and disposed to be spaced from each other at predetermined intervals along an outer circumference of the vortex finder.

A plurality of ribs extended toward a radial direction may be provided at an inside of the vortex finder to mitigate the rotational flow of discharged air.

The plurality of ribs may be installed to be spaced from each other at predetermined intervals along an inner circumference of the vortex finder.

According to still another example associated with the present disclosure, the first cyclone may include a housing formed to accommodate the second cyclone therein, and provided with an opening portion communicating with an inside on an outer circumference thereof, and a mesh filter installed to cover the opening portion to filter out and separate the dust from the air.

The housing may be disposed at an upper portion of the outer case.

An outlet of the second cyclone may be installed to pass through a bottom surface of the housing, and an inner case may be installed at a lower portion of the housing to allow the inner case to accommodate the outlet so as to collect fine dust discharged through the outlet into a fine dust storage unit within the inner case.

Dust filtered out through the mesh filter may be collected into a dust storage unit between an inner circumference of the outer case and an outer circumference of the inner case.

The dust collector for a vacuum cleaner may further include a lower cover hinge-coupled to the outer case to form a bottom surface of the outer case and the inner case during the closing, and discharge dust collected in the dust storage unit and fine dust collected in the fine dust storage unit at the same time during the opening.

A skirt may be protruded at an upper portion of the first cyclone along an outer circumferential surface thereof to prevent the scattering of dust collected in the dust storage unit.

A plurality of ribs for dust collection may be formed in a protruding manner on an inner circumference of the outer case to collect the dust introduced into the dust storage unit.

Advantageous Effects of Invention

According to the present disclosure having the foregoing configuration, the second cyclone may be accommodated into the first cyclone to reduce the height of the collector.

In such an arrangement, a first guide vane is installed between the first cyclone and the second cyclone, and a second guide vane is installed on an inlet of the second cyclone.

Air that has passed through the first cyclone may be easily introduced to the second cyclone by the first guide vane without forming an additional passage on an inlet of the second cyclone, thereby reducing introduction loss between the first cyclone and the second cyclone.

Furthermore, the second guide vane installed at an inlet of the second cyclone may strengthen rotational flow to air introduced to an inside of the second cyclone so as to enhance the separation performance of fine dust within the second cyclone.

In this manner, the degradation of collection performance in a multi-cyclone may be prevented by the first and the second guide vane.

On the other hand, according to the present disclosure, a dust storage unit and a fine dust storage unit may be configured to be both open during the separation of a lower cover, thereby discharging dust collected in the dust storage unit and fine dust collected in the fine dust storage unit at the same time during the opening.

BRIEF DESCRIPTION OF DRAWINGS

FIG. 1 is a perspective view illustrating an example of a vacuum cleaner according to the present disclosure.

FIG. 2 is a conceptual view illustrating a dust collector illustrated in FIG. 1.

FIG. 3 is a conceptual view in which the internal major configurations of a dust collector illustrated in FIG. 2 are shown in a separate manner.

FIG. 4 is a longitudinal cross-sectional view in which the dust collector of FIG. 2 is cut and seen along line IV-IV.

FIG. 5 is a longitudinal cross-sectional view in which the dust collector of FIG. 4 is cut and seen along line V-V.

FIG. 6 is a conceptual view in which a second cyclone illustrated in FIG. 3 is shown in an enlarged manner.

MODE FOR THE INVENTION

Hereinafter, a dust collector for a vacuum cleaner associated with the present disclosure will be described in more detail with reference to the accompanying drawings.

In describing an embodiment of the present disclosure, the detailed description will be omitted when a specific description for publicly known technologies to which the invention pertains is judged to obscure the gist of the present invention.

Furthermore, it should be noted that the accompanying drawings are merely illustrated to easily explain the concept of the invention, and therefore, they should not be construed to limit the concept of the invention by the accompanying drawings. The concept of the invention should be construed as being extended even to all changes, equivalents, and substitutes other than the accompanying drawings.

The terms including an ordinal number such as first, second, etc. can be used to describe various elements, but the elements should not be limited by those terms. The terms are used merely for the purpose to distinguish an element from the other element.

In case where an element is "connected" or "linked" to the other element, it may be directly connected or linked to the other element, but also should be understood that another element may exist therebetween.

Unless clearly used otherwise, expressions in the singular number include a plural meaning.

In this application, the term "comprising," "including," or the like, intends to express the existence of the characteristic, the numeral, the step, the operation, the element, the part, or the combination thereof, and does not intend to exclude another characteristic, numeral, step, operation, element, part, or any combination thereof, or any addition thereto.

FIG. 1 is a perspective view illustrating an example of a vacuum cleaner 10 according to the present disclosure.

Referring to FIG. 1, the vacuum cleaner 10 may include a power unit (not shown), a cleaner body 11, a suction unit 12 and a dust collector 100.

The power unit is configured to receive power from an outside to supply power to an inside of the cleaner body 11. The power unit may be a battery incorporated in the body or a power cable connected to the body.

The cleaner body 11 may include a fan unit (not shown) configured to receive power from the power unit to generate suction power. The fan unit may include a suction motor (not shown) and a suction fan (not shown), and the suction fan connected to the suction motor rotates according to the driving of the suction motor to generate suction flow and inhale outside air.

The suction unit 12 provided with a suction nozzle (not shown) is formed at a lower end portion of the cleaner body 11. Air and foreign substances are inhaled through the suction nozzle by suction power generated by the suction fan, and introduced into the dust collector 100.

The dust collector 100 is configured to separate and collect foreign substances from the inhaled air, and discharge air from which dust is separated. The dust collector 100 is detachably configured on the cleaner body 11. Hereinafter, the dust collector 100 according to the present disclosure will be described in detail with reference to FIGS. 2 through 6.

The entire configuration of the dust collector 100 and the flow of air and foreign substances within the dust collector 100 will be described in FIGS. 2 through 5. FIG. 2 is a conceptual view illustrating the dust collector 100 illustrated in FIG. 1, and FIG. 3 is a conceptual view in which the internal major configurations of the dust collector 100 illustrated in FIG. 2 are shown in a separate manner, and FIG. 4 is a longitudinal cross-sectional view in which the dust collector 100 of FIG. 2 is cut and seen along line IV-IV. FIG. 5 is a longitudinal cross-sectional view in which the dust collector 100 of FIG. 4 is cut and seen along line V-V.

A specific structure associated with the characteristics of the present disclosure will be described with reference to FIG. 6. FIG. 6 is a conceptual view in which a second cyclone 120 illustrated in FIG. 3 is shown in an enlarged manner.

For reference, the present drawings illustrate the dust collector 100 applied to an upright type vacuum cleaner 10, but the dust collector 100 according to the present disclosure may not be necessarily limited to the upright type vacuum cleaner 10. The dust collector 100 according to the present disclosure may be also applicable to a canister type vacuum cleaner 10.

Referring to the above drawings, air and foreign substances generated from the fan unit of the vacuum cleaner 10 are introduced to an entrance 100*a* of the dust collector 100 through the suction unit 12 by suction power generated by the fan portion of the vacuum cleaner 10. The air introduced to the entrance 100*a* is sequentially filtered at the first cyclone 110 and second cyclone 120 while flowing along a passage, and discharged through an exit 100*b*. Dust and fine dust separated from the air are collected into the dust storage unit (D1) and fine dust storage unit (D2) of the dust collector 100 which will be described later.

A cyclone refers to an apparatus for providing rotational flow to fluid in which particles are floating to separate particles from the fluid by a centrifugal force. The cyclone separates foreign substances such as dust, fine dust, and the like from air introduced to an inside of the cleaner body 11 by suction power. According to the present specification, relatively large substances are referred to as "dust," and relatively small substances are referred to as "fine dust," and dust smaller than "fine dust" is referred to as "ultra-fine dust."

The dust collector 100 may include an outer case 101, a first cyclone 110, a second cyclone 120, a cover member 130, and a first and a second guide vane 123*a*, 123*b*.

The outer case 101 forms a lateral appearance of the dust collector 100. The outer case 101 may be preferably formed in a cylindrical shape as illustrated in the drawing, but may not be necessarily limited to this. For example, the outer case 101 may be also formed in a polygonal columnar shape.

The entrance 100*a* of the dust collector 100 is formed on the outer case 101. The entrance 100*a* may be formed to be extended toward an inner circumference of the outer case 101 to allow air and foreign substances to be tangentially introduced into the outer case 101 and revolved along the inner circumference of the outer case 101. As illustrated in the drawing, the entrance 100*a* may be preferably formed at an upper portion of the outer case 101.

The first cyclone 110 is installed within the outer case 101. The first cyclone 110 is configured to filter out dust from air introduced along with foreign substances, and collect the filtered dust to the dust storage unit (D1) which will be described later. As illustrated in the drawing, the first cyclone 110 may be disposed at an upper portion within the outer case 101.

The first cyclone 110 may include a housing 111 and a mesh filter 112.

The housing 111 forms an outer appearance of the first cyclone 110, and may be formed in a cylindrical shape similarly to the outer case 101. The housing 111 may be disposed at an upper portion of the outer case 101, wherein the housing 111 may be integrally formed with the outer case 101 or configured with an additional configuration to the outer case 101 and coupled to the outer case 101.

The housing 111 is formed in a shape in which an inside thereof is vacant to accommodate the second cyclone 120. An opening portion 111*b* communicating with an inside of the housing 111 is formed on an outer circumference thereof. The opening portion 111*b* may be formed at a plurality of positions along the outer circumference of the housing 111 as illustrated in the drawing.

The first guide vane 123*a* is installed at a space between an inner circumference of the housing 111 and an outer circumference of the second cyclone 120, and the function and detailed structure of the first guide vane 123*a* will be described later.

The housing 111 may be extended with the same cross-sectional area along a downward direction as illustrated in the drawing, but may have a structure of gradually narrowing downward.

The mesh filter 112 is installed on the housing 111 to cover the opening portion 111*b*, and has a mesh or porous shape to allow air to pass therethrough. The mesh filter 112 is formed to separate dust from air introduced into the housing 111.

The criteria of separating dust from fine dust may be determined by the mesh filter 112. Foreign substances having a size of being allowed to pass through the mesh filter 112 may be divided into fine dust, and foreign substances having a size of being disallowed to pass through the mesh filter 112 may be divided into dust.

Considering the process of separating dust by the first cyclone 110 in detail, air and foreign substances are introduced into an annular space between the outer case 101 and first cyclone 110 through the entrance 100*a* of the dust collector 100 to rotationally move in the annular space.

The rotational flow of air and foreign substances in one direction in the annular space is illustrated in FIG. 5, and the "one direction" coincides with a direction in which air and fine dust that have passed through the first cyclone 110 rotationally flows by the first and the second guide vane 123*a*, 123*b*. It will be described later.

During the process, relatively heavy dust gradually flows down while rotationally moving in a spiral shape in a space between the outer case 101 and first cyclone 110 by a centrifugal force. Here, a skirt 111*c* may be formed in a protruding manner at a lower portion of the housing 111 along an outer circumference to prevent the scattering of dust collected in the dust storage unit (D1). Referring to FIG. 3, it is illustrated an example in which the skirt 111*c* is extended in an inclined manner toward the lower side.

On the other hand, contrary to dust, air is introduced into the housing 111 through the mesh filter 112 by suction power. At this time, fine dust may be also introduced into the housing 111 along with the air.

Referring to FIG. 4, it may be possible to check the internal structure of the dust collector 100 and the flow of air and foreign substances within the dust collector 100.

The second cyclone 120 is disposed within the first cyclone 110, wherein the second cyclone 120 is configured to separate air and fine dust introduced into the inside through an inlet 120*a*.

Contrary to a vertical arrangement in the related art in which the second cyclone 120 is disposed on the first cyclone 110, the second cyclone 120 of the present disclosure may be accommodated into the first cyclone 110, thereby reducing the height of the dust collector 100. The second cyclone 120 may be formed not to be protruded at an upper portion of the first cyclone 110.

Moreover, the second cyclone 120 in the related art has a guide passage extended from one side thereof to allow air and fine dust to be tangentially introduced thereinside to rotate along an inner circumference of the second cyclone 120, but the second cyclone 120 according to the present disclosure does not have such a guide passage. Accordingly, the second cyclone 120 has a circular shape when viewed from the above.

The second cyclone 120 may include a casing 121, and an upper portion of the casing 121 is partially provided with a cylindrical shape as a whole to form a truncated conical shape of gradually narrowing downward an inside of which is vacant. The structure becomes a beneficial structure for moving and collecting relatively heavy fine dust compared to air in a downward direction as well as obstructing the downward movement of air to discharge the air in an upward direction.

The inlet 120*a* for introducing air and fine dust is formed at an upper portion within the casing 121, and the vortex finder 122 for discharging air from which fine dust is filtered out to an outside thereof is installed at an upper center within the casing 121.

Furthermore, a first guide vane 123*a* is formed on an outer circumference at an upper portion of the casing 121. The first guide vane 123*a* is spirally extended between the first and the second cyclone 110, 120, and referring to FIG. 6, an example of the first guide vane 123*a* formed to be spirally extended from an upper side of an outer circumference of the second cyclone 120 is illustrated.

On the other hand, the outlet 120*b* of the second cyclone 120 for discharging fine dust is formed at a lower end portion of the casing 121.

Referring to FIGS. 4 and 5 together, a space between an inner circumference of the first cyclone and an outer circumference of the second cyclone is referred to as a first space (S1). The first space (S1) forms a passage capable of introducing air and fine dust introduced to an inside of the first cyclone 110 to an upper portion of the second cyclone 120.

The cover member 130 is disposed at an upper portion of the second cyclone 120. The cover member 130 is disposed to cover the inlet 120*a* of the second cyclone 120 at predetermined intervals to form a second space (S2) communicating the first space (S1) with the inlet 120*a*.

According to the communication relationship, air introduced into the first cyclone 110 is introduced into the inlet 120*a* at an upper portion of the second cyclone 120 through the first space (S1) and second space (S2).

Referring to FIGS. 4 through 6 together, the first guide vane 123*a* is spirally extended between the first and the second cyclone 110,120, and may be formed in a protruding manner from an inner circumference of the first cyclone 110 toward an outer circumference of the second cyclone 120, and on the contrary, formed in a protruding manner from an outer circumference of the second cyclone 120 toward an inner circumference of the second cyclone 120. Of course, the first guide vane 123*a* may be an additional member disposed between the first and the second cyclone 110, 120. FIG. 6 illustrates an example in which the first guide vane 123*a* spirally extended along an outer circumference is provided at an upper portion of the second cyclone 120.

The first guide vane 123*a* induces rotational flow to air and fine dust moving in an upward direction of the housing 111 through the mesh filter 112 to be introduced into the inlet 120*a* of the second cyclone 120. In case of a structure in the related art in which there is no first guide vane 123*a*, most of fine dust containing air is collided with the cover member 130 at an upper portion thereof and then introduced into the second cyclone 120, and thus flow loss is generated, thereby reducing the flow loss due to the first guide vane 123*a*.

A plurality of first guide vanes 123*a* may be provided, and disposed to be spaced from each other at predetermined intervals along an outer circumference of the second cyclone 120. Referring to FIG. 6, each of the first guide vanes 123*a*, disposed at a cylindrical portion on an outer circumference of the second cyclone 120, may be configured to be started from the same first position 123*a*1 and extended to the same second position 123*a*2 on the cylindrical portion. FIG. 6 illustrates an example in which the second position 123*a*2 is located at a higher place than the first position 123*a*1.

According to the present drawing, four first guide vanes 123*a* are disposed at 90° intervals along an outer circumference of the second cyclone 120. According to a design change, a larger number of the first guide vanes 123*a* may be provided compared to the illustrated example, and at least part of any one first guide vane 123*a* may be disposed to overlap with another first guide vane 123*a* in a vertical direction of the second cyclone 120.

As described above, the entrance 100*a* of the outer case 101 is extended toward an inner circumference of the outer case 101 to rotate air in "one direction," FIG. 5 illustrates an example in which air rotates in a clockwise direction. Fine dust containing air moves upward in the first space (S1) to be introduced to the inlet 120*a* of the second cyclone, and it is preferably formed with a structure configured to rotate in the same direction as the "one direction" and move upward to enhance the performance of rotational flow. Accordingly, the first guide vane 123*a* is formed in an inclined manner upward along the "one direction," and the flow of rotating in a clockwise direction is illustrated in FIG. 5.

A vortex finder 122 configured to discharge air from which fine dust has been separated is provided at the center of an upper portion of the second cyclone 120. Due to the upper structure, the inlet 120*a* may be defined as an annular space between an inner circumference of the second cyclone 120 and an outer circumference of the vortex finder 122.

A second guide vane 123*b* spirally extended along an inner circumference is provided at the inlet 120*a* of the second cyclone 120. The second guide vane 123*b* may be installed on an outer circumference of the vortex finder 122 or integrally formed with the vortex finder 122. Rotational flow is generated in air introduced to an inside of the second cyclone 120 through the inlet 120*a* by the second guide vane 123*b*.

Considering the flow of air and fine dust introduced into the inlet 120*a* in detail, the fine dust flows down while rotationally moving in a spiral shape along an inner circumference of the second cyclone 120, and is eventually discharged through the outlet 120*b* and collected in the fine dust storage unit (D2).

Furthermore, relatively light air compared to fine dust is discharged to the vortex finder 122 at an upper portion thereof by suction power. Meanwhile, a plurality of ribs 126 extended toward a radial direction may be provided on an inner circumference of the vortex finder 122 to mitigate the rotational flow of the discharged air. The plurality of ribs may be installed to be spaced from each other at predetermined intervals along the inner circumference of the vortex finder 122.

According to a structure in which the second guide vane 123*b* is disposed between the vortex finder 122 and the casing 121 as described above, contrary to the related art in which high-speed rotational flow is generated while being biased to one side by the guide passage, relatively uniform rotational flow is generated over a substantially entire region. Accordingly, local high-speed flow is not generated compared to the structure of the second cyclone 120 in the related art, thereby reducing the flow loss due to this.

A plurality of second guide vanes 123*b* may be disposed to be spaced from each other at predetermined intervals along an outer circumference of the vortex finder 122. Each of the second guide vanes 123*b* may be configured to be started from the same third position 123*b*1 and extended to the same fourth position 123*b*2 on an outer circumference of the vortex finder 122. FIG. 6 illustrates an example in which the third position 123*b*1 is located at a higher place than the fourth position 123*b*2.

As described above, an example in which the first guide vane 123*a* is formed in an inclined manner upward along the "one direction," and air and fine dust with an enhanced rotation performance is introduced to the inlet 120*a* of the second cyclone is illustrated in FIGS. 4 and 5. In correspondence to the first guide vane 123*a*, the second guide vane 123*b* is formed in an inclined manner downward along the "one direction" to further enhance the rotational flow of an inside of the second cyclone 120.

In other words, it should be a structure in which the first guide vane 123*a* rotates air and fine dust in "one direction" and move them upward, and such a structure may minimize the loss of rotational flow in the first and the second guide vane 123*a*, 123*b*.

Referring to FIG. 6, it is illustrated an example in which the first guide vane 123*a* is formed in an inclined manner upward along a clockwise direction (the one direction), and the second guide vane 123*b* is formed in an inclined manner downward along a clockwise direction.

According to the present drawing, four second guide vanes 123*b* are disposed at 90° intervals along an outer circumference of the vortex finder 122. According to a design change, a larger number of the second guide vanes 123*b* may be provided compared to the illustrated example, and at least part of any one second guide vane 123*b* may be disposed to overlap with another second guide vane 123*b* in a vertical direction of the vortex finder 122.

On the other hand, a lower diameter of the vortex finder 122 may be formed to be less than an upper diameter thereof. According to the foregoing shape, an area of the inlet 120*a* may be decreased to increase a speed of flowing into the second cyclone 120, and fine dust introduced into the second cyclone 120 may be limited from being discharged through the vortex finder 122 along with air.

According to the present drawing, a taper portion 122*a* a diameter of which gradually decreases as being located at an end portion may be formed at a lower portion of the vortex finder 122. On the contrary, a diameter of the vortex finder 122 may be formed to gradually decrease as being located from an upper portion to a lower portion.

The exit 100*b* of the dust collector 100 is formed on the cover member 130 to discharge air. The upper cover 140 may form an upper appearance of the dust collector 100. Air discharged through the exit 100*b* of the dust collector 100 may be discharged through an exhaust port (not shown) of the cleaner body 11 to an outside thereof. A porous pre-filter 145 configured to filter out ultra-fine dust from air may be installed on a passage extended from the exit 100*b* of the dust collector 100 to the exhaust port of the cleaner body 11.

On the other hand, the outlet 120*b* of the second cyclone 120 is installed to pass through a bottom surface 111*d* of the first cyclone 110. A through hole 111*d*' for the insertion of the second cyclone 120 is formed on the bottom surface 111*d* of the first cyclone 110.

The inner case 150 accommodating the outlet 120*b* is installed at a lower portion of the first cyclone 110 to form the fine dust storage unit (D2) for collecting fine dust discharged through the outlet 120*b*. A lower cover 160 which will be described later forms a bottom surface of the fine dust storage unit (D2).

The inner case 150 is extended from a lower end of the housing 111 toward a lower portion of the outer case 101 to accommodate the outlet 120*b* of the second cyclone 120. The inner case 150 may be extended in a direction parallel to an extension direction of the outer case 101. According to the foregoing structure, fine dust discharged through the outlet 120*b* is collected into the inner case 150.

On the other hand, dust filtered out through the first cyclone 110 is collected into the dust storage unit (D1) between an inner circumference of the outer case 101 and an outer circumference of the inner case 150. The bottom surface of the dust storage unit (D1) may be formed by the lower cover 160 in the following.

Referring to FIG. 3, both the dust storage unit (D1) and fine dust storage unit (D2) are formed to be open toward a lower portion of the outer case 101. The lower cover 160 is coupled to the outer case 101 to cover an opening portion of the dust storage unit (D1) and fine dust storage unit (D2) so as to form a bottom surface of the dust storage unit (D1) and fine dust storage unit (D2).

As described above, the lower cover 160 is coupled to the outer case 101 to open or close a lower portion thereof. According to the present embodiment, it is illustrated that the lower cover 160 is coupled to the outer case 101 through a hinge 161 to open or close a lower portion of the outer case 101 according to the rotation thereof. However, the present disclosure may not be necessarily limited to this, and the lower cover 160 may be also coupled to the outer case 101 in a completely detachable manner.

The lower cover 160 is coupled to the outer case 101 to form a bottom surface of the dust storage unit (D1) and fine dust storage unit (D2). The lower cover 160 is rotated by the hinge 161 to discharge dust and fine dust at the same time so as to open the dust storage unit (D1) and fine dust storage unit (D2) at the same time. When the lower cover 160 is rotated by the hinge 161 to open the dust storage unit (D1) and fine dust storage unit (D2) at the same time, it may be possible to discharge dust and fine dust at the same time.

A plurality of ribs 103 for dust collection may be formed in a protruding manner on an inner circumference of the outer case 101 to collect the dust introduced into the dust storage unit (D1), and the ribs for dust collection may be protruded toward the center of the outer case 101, for an example. A plurality of ribs for dust collection may be provided, and in this case, installed to be spaced from each other at predetermined intervals along an inner circumference of the outer case 101.

The ribs for dust collection may prevent dust collected in the dust storage unit (D1) from being rotated by the rotational flow of air introduced from an outside thereof, and prevent dust from being scattered or discharged to an unintentional place during the process of discharging dust, thereby facilitating the discharge of dust.

According to the present disclosure having the foregoing configuration, the second cyclone 120 may be accommodated into the first cyclone 110 to reduce the height of the collector.

In such an arrangement, a first guide vane 123*a* is installed between the first cyclone 110 and the second cyclone 120, and a second guide vane 123*b* is installed on an inlet of the second cyclone 120.

Air that has passed through the first cyclone 110 may be easily introduced to the second cyclone 120 by the first guide vane 123*a* without forming an additional passage on an inlet of the second cyclone 120, thereby reducing introduction loss between the first cyclone 110 and the second cyclone 120.

Furthermore, the second guide vane 123*b* installed at an inlet of the second cyclone 120 may strengthen rotational flow to air introduced to an inside of the second cyclone 120 so as to enhance the separation performance of fine dust within the second cyclone 120.

In this manner, the degradation of collection performance in a multi-cyclone may be prevented by the structure of the first and the second guide vane 123*a*, 123*b*.

On the other hand, according to the present disclosure, a dust storage unit (D1) and a fine dust storage unit (D2) may be configured to be both open during the separation of a lower cover 160, thereby discharging dust collected in the dust storage unit (D1) and fine dust collected in the fine dust storage unit (D2) at the same time during the opening.

The present invention may be embodied in other specific forms without departing from the concept and essential characteristics thereof. The detailed description is, therefore, not to be construed as illustrative in all respects but considered as restrictive. The scope of the invention should be determined by reasonable interpretation of the appended claims and all changes that come within the equivalent scope of the invention are included in the scope of the invention.

The invention claimed is:

1. A dust collector for a vacuum cleaner, comprising:

a first cyclone within an upper portion of an outer case to filter out dust from air introduced from an outside of the outer case and to introduce air from which dust has been filtered out to an inside of the first cyclone;

a second cyclone accommodated in the inside of the first cyclone to separate fine dust from air introduced to the inside of the first cyclone;

a plurality of first guide vanes spirally extended from an annular shaped first space between the first cyclone and the second cyclone to induce a rotational flow so as to direct air introduced into the first space to an inlet of the second cyclone; and a plurality of second guide vanes spirally extended along an inner circumference surface of the inlet to enhance the rotational flow of air introduced to an inside of the second cyclone through the inlet, wherein each of the plurality of first guide vanes is inclined to extend upwardly in a rotational flow direction toward the inlet of the second cyclone, wherein each of the plurality of second guide vanes is inclined to extend downwardly in the rotational flow direction toward the inside of the second cyclone, and wherein intersections between adjacent pairs of the plurality of first guide vanes are offset in a circumferential direction with respect to intersections between adjacent pairs of the plurality of second guide vanes.

2. The dust collector of claim 1, wherein the plurality of first guide vanes are positioned to be spaced from each other at predetermined intervals along an inner circumference surface of the first cyclone or an outer circumference surface of the second cyclone.

3. The dust collector of claim 2, wherein an entrance extended toward an inner circumference surface of the outer case is formed at the upper portion of the outer case to rotate air introduced from an outside in the rotational flow direction, and the plurality of first guide vanes are formed in the rotational flow direction to rotate and move air introduced into the first space upward in the rotational flow direction.

4. The dust collector of claim 3, wherein the plurality of first guide vanes are formed to be protruded from the outer circumference surface of the second cyclone toward the inner circumference surface of the first cyclone.

5. The dust collector of claim 3, wherein the plurality of second guide vanes are formed in the rotational flow direction to allow air rotated and moved upward in the rotational flow direction along the plurality of first guide vanes to be rotated and moved downward in the rotational flow direction and introduced to an inside of the second cyclone.

6. The dust collector of claim 2, wherein an end of any first one of the plurality of first guide vanes overlaps an end of an adjacent second one of the plurality of first guide vanes in a vertical direction of the second cyclone.

7. The dust collector of claim 1, wherein a vortex finder is provided at the inside of the second cyclone to discharge air from which fine dust has been separated, and the plurality of second guide vanes are installed on the inlet, which is a space between the vortex finder and an inner circumference surface of the second cyclone.

8. The dust collector of claim 7, wherein the plurality of second guide vanes are positioned to be spaced from each other at predetermined intervals along an outer circumference surface of the vortex finder.

9. The dust collector of claim 8, wherein an end of any first one of the plurality of second guide vanes overlaps an end of an adjacent second one of the plurality of second guide vanes in a vertical direction of the vortex finder.

10. The dust collector of claim 7, wherein a plurality of ribs extended radially are provided at an inside of the vortex finder to mitigate the rotational flow of discharged air.

11. The dust collector of claim 10, wherein the plurality of first guide vanes are positioned to be spaced from each other at predetermined intervals along an inner circumference surface of the first cyclone or an outer circumference surface of the second cyclone, and wherein each of the plurality of ribs extends in a radial direction that corresponds to an intersection between an adjacent pair of the plurality of first guide vanes.

12. The dust collector of claim 7, wherein the vortex finder includes a taper portion formed at a lower end thereof, a diameter of taper portion progressively decreasing toward the lower end of the taper portion.

13. The dust collector of claim 1, wherein the first cyclone includes:

a housing formed to accommodate the second cyclone therein and provided with an opening portion communicating with an inside on an outer circumference surface thereof; and a mesh filter installed to cover the opening portion to filter out and separate the dust from air.

14. The dust collector of claim 13, wherein an outlet of the second cyclone is installed to pass through a bottom surface of the housing, and an inner case is installed at a lower portion of the housing to allow the inner case to accommodate the outlet so as to collect fine dust discharged through the outlet into a fine dust storage unit within the inner case.

15. The dust collector of claim 14, wherein dust filtered out through the mesh filter is collected into a dust storage unit between an inner circumference surface of the outer case and an outer circumference surface of the inner case, and the dust collector further comprises:

a lower cover that is hinge-coupled to the outer case to form a bottom surface of the outer case and the inner case when closed, and discharges dust collected in the dust storage unit and fine dust collected in the fine dust storage unit at a same time when opened.

16. The dust collector of claim 15, wherein a plurality of ribs for dust collection protrude from the inner circumference surface of the outer case to collect the dust introduced into the dust storage unit.

17. The dust collector of claim 13, wherein the first cyclone further includes a skirt that protrudes outward at an incline from the outer circumference surface of the housing below the opening portion.

18. The dust collector of claim 1, further comprising an upper cover mounted on an upper end of the second cyclone to cover the first space between the first cyclone and the second cyclone.

19. The dust collector of claim 1, wherein the second cyclone includes a casing having a truncated conical shape that is gradually narrowing downward.

* * * * *